US009073345B2

(12) United States Patent
Caporossi et al.

(10) Patent No.: US 9,073,345 B2
(45) **Date of Patent: *Jul. 7, 2015**

(54) APPARATUS, SYSTEM AND METHOD FOR CONTROLLING A PRINT HEAD

(71) Applicants: James Caporossi, Highland Parks, NJ (US); Scott A. Margo, Colonia, NJ (US)

(72) Inventors: James Caporossi, Highland Parks, NJ (US); Scott A. Margo, Colonia, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/277,076

(22) Filed: May 14, 2014

(65) Prior Publication Data

US 2014/0292990 A1 Oct. 2, 2014

Related U.S. Application Data

(63) Continuation of application No. 13/363,941, filed on Feb. 1, 2012, now Pat. No. 8,736,647.

(60) Provisional application No. 61/438,414, filed on Feb. 1, 2011.

(51) Int. Cl.

| | |
|---|---|
| ***B41J 2/35*** | (2006.01) |
| ***B41J 2/335*** | (2006.01) |
| ***B41J 2/355*** | (2006.01) |

(52) U.S. Cl.

CPC ..... *B41J 2/3352* (2013.01); *B41J 2/355* (2013.01)

(58) Field of Classification Search

USPC ..... 347/179, 180–182, 188, 195, 211; 400/120.05, 120.06, 120.09, 120.15

See application file for complete search history.

(56) References Cited

U.S. PATENT DOCUMENTS

| | | | | |
|---|---|---|---|---|
| 8,736,647 | B2 * | 5/2014 | Caporossi et al. | 347/179 |
| 8,736,649 | B2 * | 5/2014 | Caporossi et al. | 347/211 |

* cited by examiner

*Primary Examiner* — Kristal Feggins

(74) *Attorney, Agent, or Firm* — Barnes & Thornburg LLP; Thomas J. McWilliams; Edward F. Behm, Jr.

(57) ABSTRACT

The present invention is and includes a conversion circuit for allowing a printer controller to send a different set of control signals for dot history control to an integrated circuit driver other than those which the integrated circuit driver is designed to receive. The conversion circuit includes a plurality of driver circuits coupled to a plurality of strobe signals from at least one strobe signal generator, wherein each of the plurality of driver circuits comprises a plurality of gating groups respectively coupled to the plurality of strobe signals, wherein each of the plurality of gating groups includes a plurality of gate units respectively coupled to a plurality of heating elements wherein at least one gate unit controls at least one coupled heating element according to a corresponding strobe signal.

4 Claims, 5 Drawing Sheets

APPARATUS, SYSTEM AND METHOD FOR CONTROLLING A PRINT HEAD

CROSS-REFERENCE TO RELATED APPLICATION

This application is a continuation of U.S. patent application Ser. No. 13/363,941, entitled APPARATUS, SYSTEM AND METHOD FOR CONTROLLING A PRINT HEAD, filed Feb. 21, 2012, which claims the benefit of priority to U.S. Patent Application No. 61/438,414, entitled APPARATUS, SYSTEM AND METHOD FOR CONTROLLING A PRINT HEAD, filed on Feb. 1, 2011, the entirety of which is incorporated herein by reference.

BACKGROUND OF THE INVENTION

1. Field of the Invention

The present invention is directed to a signal conversion circuit and, more particularly, to an apparatus, system and method for converting thermal printhead dot history control signals from one type to a different type.

2. Description of the Background

Typical printers may be classified into four major categories: dot matrix printers, inkjet printers, laser printers, and thermal sublimation (or thermal transfer) printers. Thermal printers have become increasingly popular due to their economical performance. A thermal printer uses a thermal print head (TPH) to heat ribbons or paper containing dyes. The dyes of the heated ribbon are transferred onto the object to be printed or change the dye in the paper dark or a color (usually black).

More specifically, a TPH may print on an output medium by, for example, transferring pigment from a donor sheet to the output medium or by initiating a color-forming reaction in the output medium. The output medium may be a porous receiver receptive to the transferred pigment, or a paper coated with the color-forming chemistry, for example. Each of the TPHs, when activated, may form color on the medium passing underneath the TPH, creating a spot having a particular density. Regions with larger or denser spots are perceived as darker than regions with smaller or less dense spots. Digital images are rendered as two-dimensional arrays of very small and closely-spaced spots.

Furthermore, TPHs may be expensive and unique to particular manufacturers and printer models. In particular, various TPH manufacturers may produce TPHs capable of using dot history control (DHC) for which specific integrated circuit drivers (ICs) are used to control signal timing from the printer to the TPH. By producing THPs with unique ICs matched to specific models and brands of printers, THP manufacturers severely limit the constituent parts used to make a TPH to be used with a particular printer.

Thus, the need exists for an apparatus, system and method to allow for interchangeable and compatible integrated circuit drivers for thermal print heads and related apparatuses to solve the above-mentioned problems.

SUMMARY OF THE INVENTION

The apparatus, system and method of the present invention are and include a signal converter for use in a thermal print head. The signal converter may include a plurality of driver circuits for driving the thermal printhead and coupled to a plurality of strobe signals from at least one strobe signal generator. Each of the plurality of driver circuits may include a plurality of gating groups respectively coupled to the plurality of strobe signals, wherein each of the plurality of gating groups includes a plurality of gates respectively coupled to a plurality of heating elements. At least one gate may control at least one coupled heating element by converting a driver signal for use by that at least one heating element according to a corresponding strobe signal.

Thus, the present invention provides an apparatus, system and method to allow for interchangeable and compatible integrated circuit drivers for thermal print heads and related apparatuses.

BRIEF DESCRIPTION OF THE DRAWINGS

Understanding of the disclosure will be facilitated by consideration of the following detailed description of the embodiments, taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for the purposes of clarity, many other elements found in typical printing apparatuses, systems and methods. Those of ordinary skill in the art will recognize that other elements are desirable and/or required in order to implement the present invention. However, because such elements are well known in the art, and because they do not facilitate a better understanding of the present invention, a discussion of such elements is not provided herein.

In a conventional TPH, a plurality of ICs may be provided on a ceramic wafer along with the necessary heat elements. The purpose of the ICs may be to switch the heat elements on and off. ICs may, for example, be provided with: a shift register that stores data consisting of as many bits as the resistive elements that the driver device needs to drive; a plurality of logic gates that feed the data of the individual bits of a shift register to a transistor; a plurality of transistors that drive the resistive elements; and output terminals connected to the resistive elements or heaters.

The present invention provides a conversion circuit to allow a printer controller to send a different set of control signals for Dot History Control (DHC) to an IC than the IC is designed to receive. Common elements of a DHC system in the current art are discussed hereinbelow with respect to FIG. 1, and typical TPH printing using such a system is discussed hereinbelow with respect to FIG. 2. For example, the present invention allows a printer controller programmed to send five (5) DHC controller signals to be interlaced with an IC designed to receive seven (7) DHC controller signals, such as using the conversion circuit of the present invention discussed hereinbelow with respect to FIGS. 3A-4B. Similarly, to facilitate communication between a printer controller using seven (7) DHC controller signals and an IC designed to receive five (5) DHC controller signals, the exemplary conversion circuit of the present invention may be similarly employed.

By way of background, in a conventional TPH, a plurality of ICs may be provided on a ceramic wafer along with the necessary heat elements. The purpose of the ICs may be to switch the heat elements on and off. ICs may, for example, be provided with: a shift register that stores data consisting of as many bits as the resistive elements that the driver device needs to drive; a plurality of logic gates that feed the data of the individual bits of a shift register to a transistor; a plurality of transistors that drive the resistive elements; and output terminals connected to the resistive elements or heaters.

Figure 1:
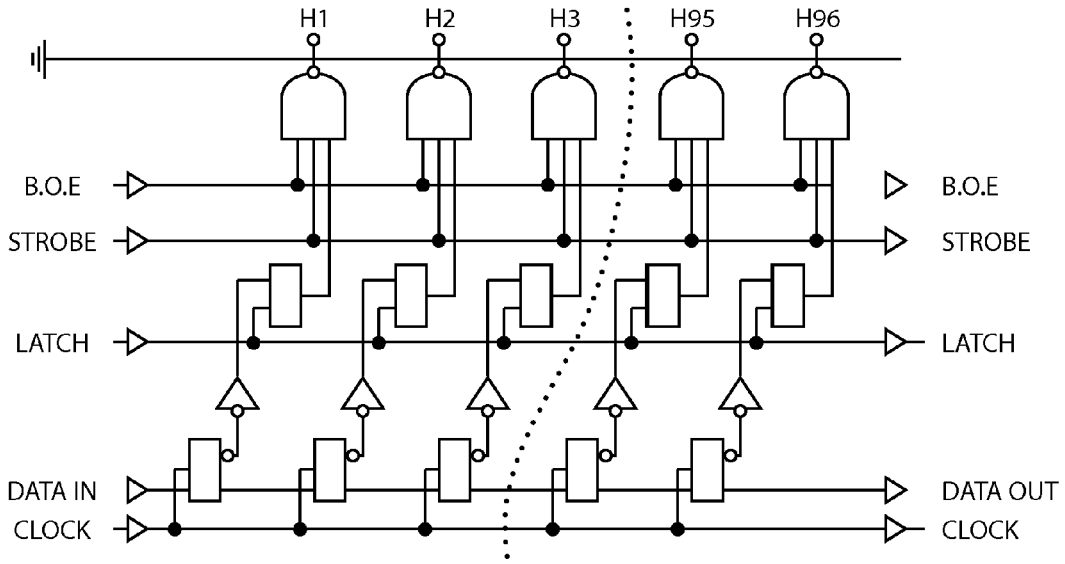
FIG. 1 is a circuit diagram that illustrates the system of communicative parts in accordance with the present invention.

These IC elements may be controlled by a plurality of control signals which, in turn, may fire a plurality of heaters. As illustrated in FIG. 1, a typical IC may control a plurality of heaters, labeled H1-Hn, where n may be 200 to 2000 or more heaters on printheads containing Dot History, connected to a common voltage. ICs may have differing requirements for the number of control signals needed, typically between four (4) and twelve (12) depending on the IC, by way of non-limiting example. As illustrated in FIG. 1, typical control signals may include a block enable out (BEO) pulse, a strobe pulse, a latch pulse, a clock pulse, and a data bit. Data bits may typically be presented as "high" for executing printing and "low" for not printing. For example, a printer controller may present a data bit on the DATA IN pin and pulse the clock pin. The data bit may then be copied into the leftmost shift register on the rising clock pulse—with any existing data shifting to the rightmost register. The IC may repeat this exercise a number of times equal to the number of heaters on the TPH, for example. A latch pulse may then cause the data bits to be copied to the latch registers to await the assertion of the strobe and BEO pins. Current will flow into heater elements having a high data bit in the respective latch register, for example, for as long as the strobe and BEO are enabled active.

Additional control signals may also include dot history control (DHC), herein also referred to as heat history control. DHC may include techniques for reducing pulse width when a heater element has retained heat from firing on a previous print line. A primary advantage to using DHC in a printer may be to improve the quality of printer during high speed operation. E type signaling DHC may include, for example, techniques for reducing pulse width when a heater element has retained heat from firing on a previous print line. A primary advantage to using DHC in a printer may be to improve the quality of printer during high speed operation. An additional advantage of DHC may be that without utilizing DHC, heaters running "hot" may need to be turned off to allow for temperature equalization with unfired heater elements in the same IC, for example. Without controlling the overall temperature of the heater elements through DHC, the heater elements may overheat during printing and may promote poor print quality by damaging or "burning out" the resistor heaters and a shortening of the over life of the IC. Further, the use of DHC may allow for greater energy efficiency, and may reduce the overall energy consumed during printing.

For K type DHC, the ICs may receive a strobe signal firing all selected heater elements for the same amount of time. Utilizing DHC, the printer controller may briefly fire the individual heater elements using a strobe pulse varied in width by printed dot. This function, which may be computed by the printer controller, may, for example, be implemented using five (5) additional control signals, which the printer controller holds low for progressively shorter amounts of time. The printer controller, or IC driver, may choose which controller signal pulse width to use for each printed dot based on at least one function of that dot's immediate state, the immediate states of adjacent dots and the previous states of the current and adjacent dots.

Figure 4A:
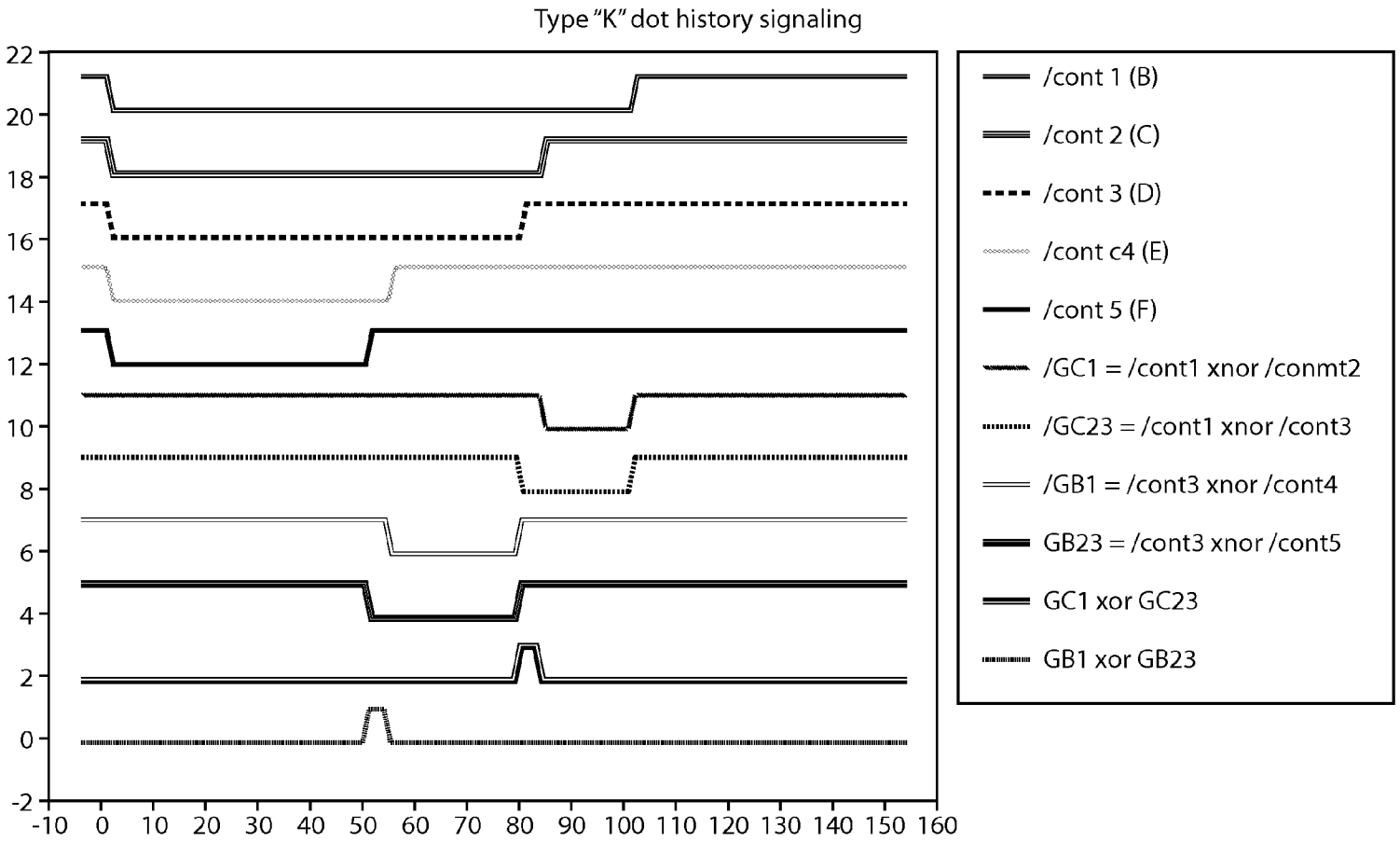
FIG. 4A is a signaling diagram that illustrates the signal timing of the originating and the converted thermal history control signals sent to an integrated circuit driver in accordance with the present invention.

As illustrated in FIG. 4A, E type signaling, seven (7) controller signals may be used for DHC within an IC. In accordance with the depicted printing direction, the lowermost circles are black to indicate that these heater elements have been selected to fire on that print line. The two circles above indicate whether or not the heater element fired in the at least two previous lines.

For example, K type signaling, "cont. 1" is the warmest corresponding to the longest heater on time, while "cont. 5" is relatively coolest. To print these two dots on the present print line with a substantially similar optical density, for example, the printer controller in combination with the driver ICs must hold "cont. 1" low for a longer time than "cont. 5". Thus, the IC may switch a heating element on as long as the appropriate controller signal are enabled, in the present invention the strobe pulse is low, the BOE is high, and the data bit in the latch register is high.

In an embodiment of the present invention, a conversion circuit is provided to allow a printer controller to send a different set of control signals for DHC to an IC than the IC is designed to receive. For example, a printer controller programmed to send five (7) DHC controller signals may be interfaced with an IC designed to receive seven (7) DHC controller signals, using a conversion circuit of the present invention, which is K type to E type conversion. Similarly, to facilitate communication between a printer controller using seven (7) DHC controller signals and an IC designed to receive five (5) DHC controller signals, the conversion circuit example similar present invention may be employed, which is E type to K type conversion.

Figure 3A:
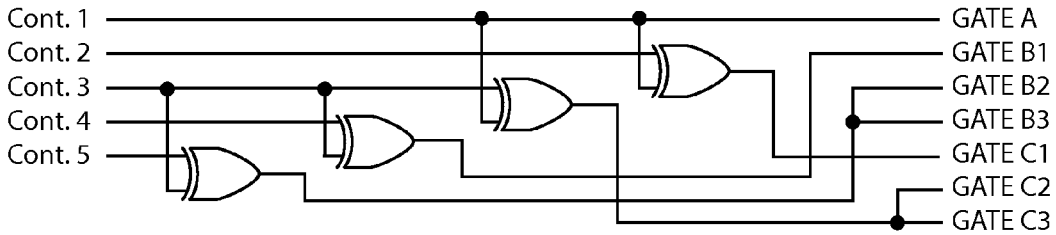
FIG. 3A is a circuit diagram that illustrates a portion of an integrated circuit driver in accordance with the present invention; signal conversion between 5 signal Dot History Control and 7 signal Dot History Control.
Figure 3B:
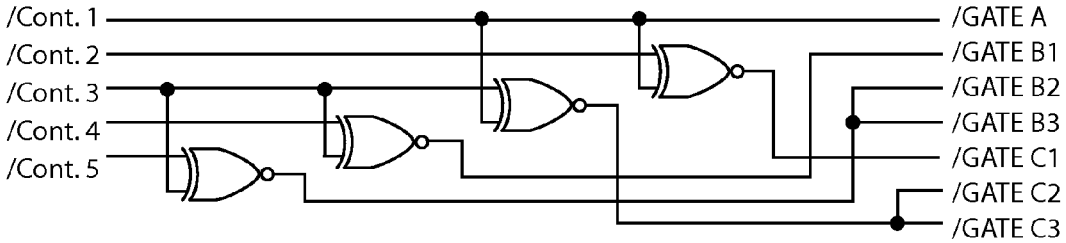
FIG. 3B is a circuit diagram that illustrates a portion of an integrated circuit driver in accordance with the present invention; signal conversion between 5 signal Dot History Control and 7 signal Dot History Control.

As illustrated in FIG. 3A, a conversion circuit may allow for the input of five (5) controller signals, each of which may vary as to different lengths of heater "turn on" times, which may be converted into seven (7) controller signals. These seven (7) controller signal control the power to the heater by trimming or shortening a reference heater's "on time" For example, one or more received DHC signals may control at least two heater elements. As illustrated in FIG. 3A, a "cont. 5" signal may be used to control two gates, namely Gates B2 and B3. Similarly, an XOR gate may be used for receiving both "cont, 5" and "cont. 3" signals, for example, and may also provide control over Gates B2 and B3.

Figure 2:
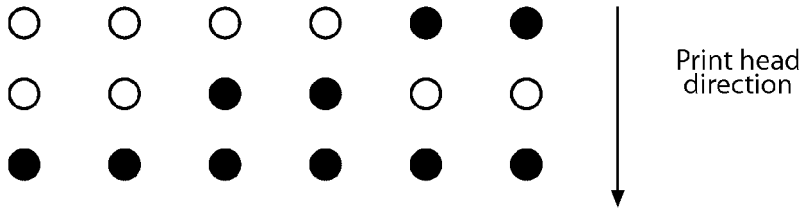
FIG. 2 is an illustration of dot history control in accordance with the present invention.

FIG. 4A, as referred above, illustrates a timing chart further illustrating signals related to at least one signal combination for at least one line of dots in FIG. 2 utilizing the conversion circuit of the present invention. The timing chart of FIG. 4A illustrates five (5) input DHC signals (/cont1 to /cont5) having highs and lows and signal strength along with four (4) created trim signals (/GC1, /GC23, /GB1, /GB23). These trim signals, which are created by the exemplary circuit, may be expanded to seven signals (/GC23 is /GC2 and /GC3, etc.), such as to be used to control a driver IC intended for seven control signals. For example, Gates B2 and B3 may be controlled by XNOR function using signals from "cont. 3" and "cont, 5" in accordance with the signals and highs and lows associated with the input signals. Similarly, Gate C1 may be controlled by XNOR function using signals from "cont. 1" and "cont, 2" in accordance with the signal strength and highs and lows associated with the input signals. In the example, Gate A does not need signal conversion, as it is the same signal as /cont1.

Figure 4B:
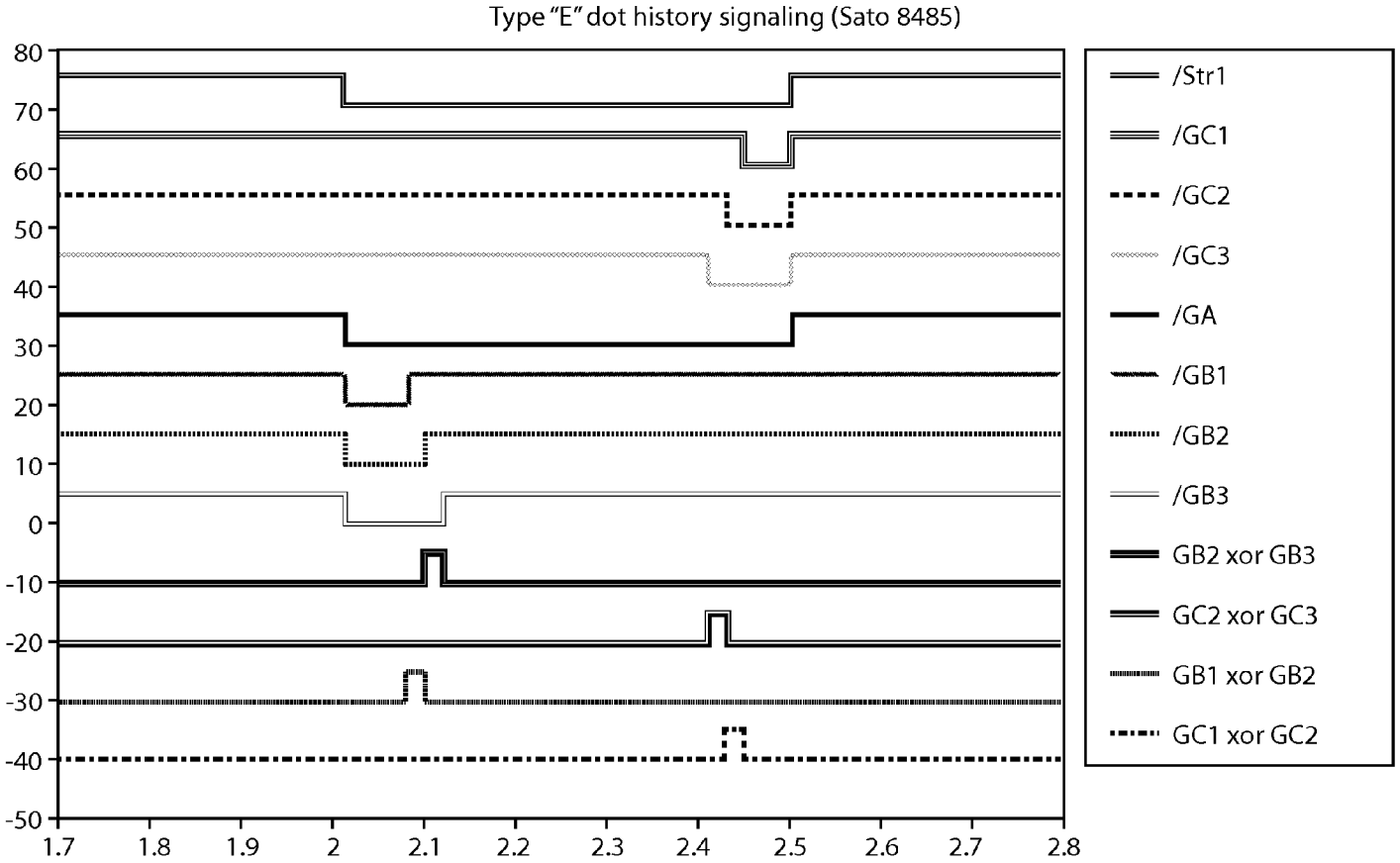
FIG. 4B is a signaling diagram that illustrates the signal timing of the thermal history control signals as intended for readily available an integrated circuit driver chips in accordance with the present invention.

The present invention may also allow for the control of five (5) THC signals from the printer intended to control ICs requiring seven (7) THC signals (in addition to the standard control signals). As illustrated in FIG. 4B, the signaling associated with the conversion of seven (7) input DHC signals to five (5) control signals may include signals produced through at least four (4) XOR gates, for example.

Although the invention has been described and pictured in an exemplary form with a certain degree of particularity, it is understood that the present disclosure of the exemplary form has been made by way of example, and that numerous changes in the details of construction and combination and arrangement of parts and steps may be made without departing from the spirit and scope of the invention; the conversion of one DHC scheme to another.

What is claimed is:

1. A signal converter system for use in a thermal print head, comprising:

a plurality of heating elements for applying thermal printing by the thermal print head;

a printer controller provided to control the thermal printing, wherein said printer controller outputs a first scheme comprising at least one control signal;

a receiving IC for receiving a second scheme comprising at least one control signal to control said plurality of heating elements;

at least one gate capable of converting the first scheme of at least one control signal to the second scheme of at least one control signal.

2. The system of claim 1, wherein the at least one gate comprises a trimming circuit that effectuates the converting.

3. The system of claim 1, wherein at least one gate comprises an XOR gate.

4. The system of claim 1, wherein at least one gate comprises an XNOR gate.

* * * * *